US005269527A

United States Patent [19]

Noval

[11] Patent Number: 5,269,527

[45] Date of Patent: Dec. 14, 1993

[54] SPORTS NET

[76] Inventor: Charles B. Noval, 1120 Union St., San Francisco, Calif. 94401

[21] Appl. No.: 935,134

[22] Filed: Aug. 21, 1992

Related U.S. Application Data

[63] Continuation of Ser. No. 935,134, Jul. 29, 1991, abandoned.

[51] Int. Cl.[5] ..... A63B 63/00

[52] U.S. Cl. ..... 273/181 F; 273/26 A; 273/411

[58] Field of Search ..... 273/181, 32 R, 26 A, 273/407, 410, 411, 35 R, 29 B, 31

[56] References Cited

U.S. PATENT DOCUMENTS

| | | | |
|---|---|---|---|
| 2,922,653 | 1/1960 | O'Brien | 273/410 |
| 3,001,795 | 9/1961 | Johnson | 273/181 F |
| 3,822,063 | 7/1974 | Rea | 273/410 |
| 3,945,641 | 3/1976 | Carbonero | 273/411 |
| 4,088,317 | 5/1978 | Gierla | 273/29 B |
| 4,688,804 | 8/1987 | Maxwell | 273/407 |
| 4,702,478 | 10/1987 | Kruse | 273/410 |
| 4,815,736 | 3/1989 | Wright | 273/181 F |
| 4,822,053 | 4/1989 | Flaherty | 273/411 |
| 4,895,366 | 1/1990 | Bartasius | 273/29 B |
| 5,088,740 | 2/1992 | Peterson | 273/410 |

*Primary Examiner*—Mark S. Graham

*Attorney, Agent, or Firm*—Owen, Wickersham & Erickson

[57] ABSTRACT

A net support assembly for training and practicing sports which use sports projectiles is disclosed. The assembly is lightweight, easy to setup, portable, and versatile. A shock-corded segmented fiberglass pole formed into an arch is supported from the ground or other fixed support structure. A durable extra long nylon net is loosely draped within the arch to receive and dissipate the energy of any sports projectiles (e.g. golf balls, soccer balls, baseballs, footballs, etc.) which may be directed into the net. The flexible movement of the top of the arch also helps to dissipate the energy. The expanse (height and width) of the net can be adjusted to vary the height of the arch according to the user's needs. The net is attached to the arched pole by rings attached to the net and surrounding the pole. The rings are captured on the pole by stoppers preventing the rings from sliding off the ends of the pole thereby avoiding the assembly step of threading the net on the pole. Metal tips are provided on the ends of the pole to assist in placing the ends of the pole into the ground.

An above ground support structure also is disclosed which may be used when placing the ends of the pole in the ground is not feasible. When the pole is disassembled into several pieces and the net is wrapped around the poles, it is easily stored in a small portable bag for easy transport and immediate reassembly.

30 Claims, 3 Drawing Sheets

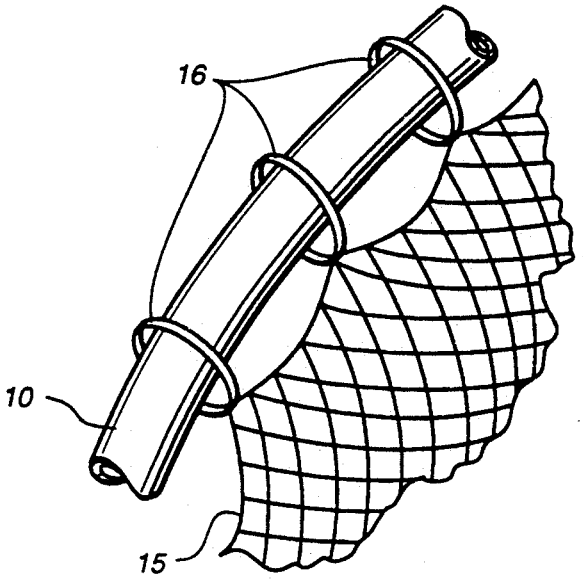
FIG._4
FIG._7
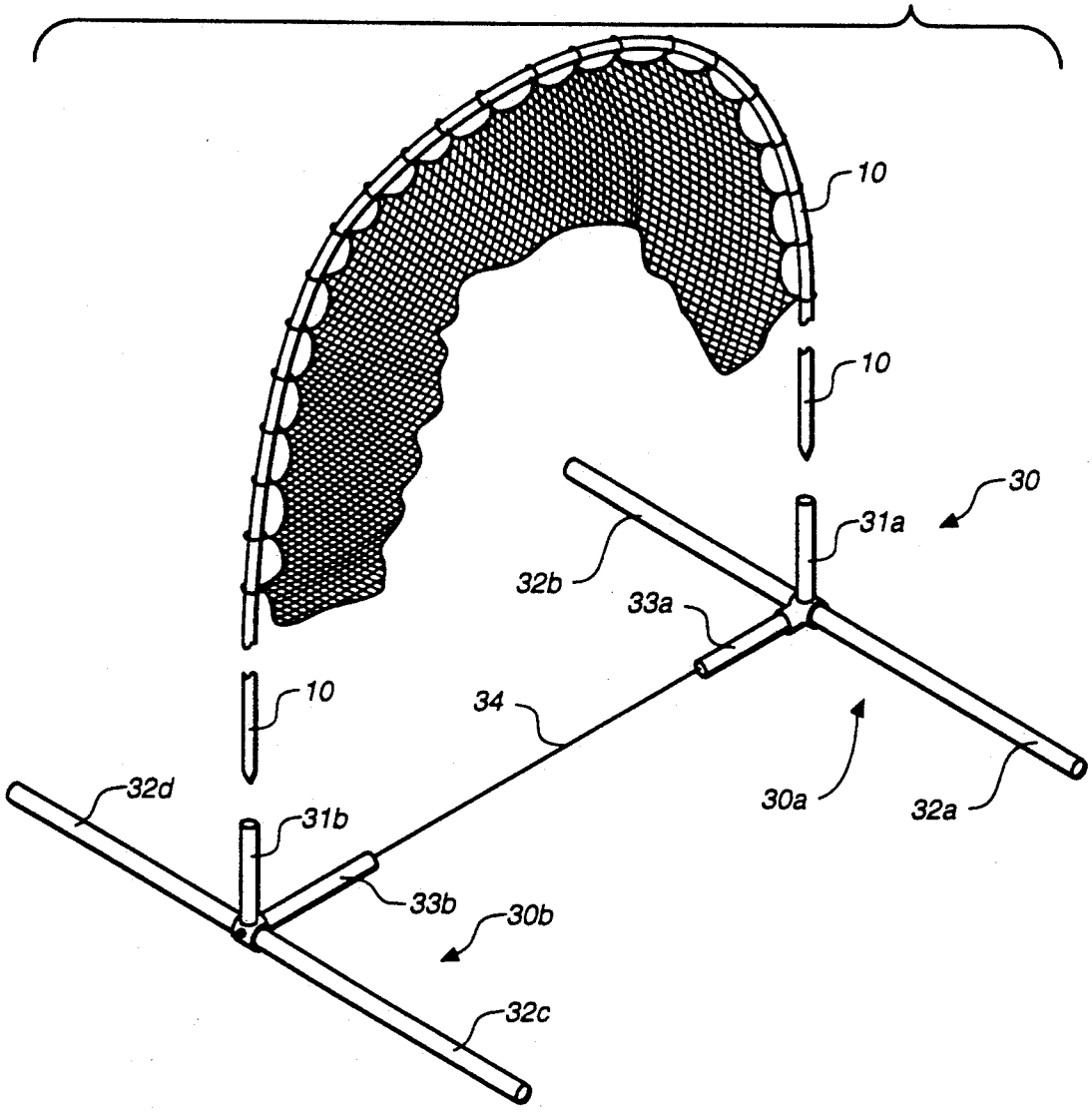

SPORTS NET

This application is a continuation of application Ser. No. 07/935,134, filed Jul. 29, 1991, now abandoned.

BACKGROUND OF THE INVENTION

1. Field of the Invention

This invention relates to the field of temporary barriers (e.g. nets) often used in training for sports (e.g. golf, soccer, baseball).

2. Prior Art

Many devices which act as sports projectile nets exist. They are all cumbersome, heavy, complicated, time consuming to setup, and require a large amount of effort to assemble and disassemble for use. These burdens are a disincentive to practice a selected sport using these devices. Many nets have a large number of pieces which increase the complexity of assembly. These pieces can be easily lost and require extensive instructions to setup (e.g. proper alignment of curved pieces fitting together with adjacent curved or straight pieces). Further, past nets require multiple anchor points (e.g. guy wires) to prevent them from falling over during use and/or unfavorable environmental conditions (i.e. rain, wind storms).

The difficult, cumbersome, complex, and time consuming assembly and disassembly processes create a disincentive to perform the assembly and disassembly processes. Therefore, many of these prior art devices are left assembled for use for long periods of time. During these long periods of time when the nets are assembled, but not in use they become subject to environmental degradation as well as accidents involving children, pets, and wild animals.

The heavy weight and bulky size of the disassembled stored units is not easily transportable and again provides a disincentive to practice.

Among the features which make the prior art devices difficult to assemble are the fact that the frame structure first needs to be assembled. The frame structure is usually constructed of many pieces which require a particular orientation and alignment to position them properly. The attachment of any netting to the frame structure also is complex, especially if it is necessary to insert parts of the structure through openings or sleeves in the netting and then reassemble the structure.

SUMMARY OF THE INVENTION

This invention provides a barrier forming device that is a single pole forming a generally vertical and generally arcuate arch. A barrier forming material (preferably fabric or netting) is draped from the arch shaped pole and substantially fills the arch. The barrier forming material has a size and weight sufficient to act as a barrier to stop sports projectiles. The single pole forming a generally vertical arch is held in a generally vertical position and the barrier forming material is draped from and along the pole to create a barrier for sports projectiles. The pole can be flexible (i.e. a multi-segmented shock-corded fiberglass pole, similar to those used to support modern dome type tents) such that when the ends of the pole ends are moved together until the ends are substantially parallel, the pole forms an arch. The pole ends are placed into the ground and the ground thereby holds the pole in an arch shape. An above ground stand which has a pole receiving tube for each pole end can also be used. When the pole ends are fixed in the ground a top portion of the arch is free to move in a lateral direction so as to absorb energy from any sport projectile (i.e. golf ball, soccer ball, baseball, etc.) stopped by the barrier.

The pole may be constructed in segments so that when disassembled the pole can be stored in a short small area. The pole ends can also be supported from a fixed structure having other means for fixing the pole ends and holding the pole up in its arch shape. Any fixed structure holding the pole, holds the pole ends generally parallel and generally vertical.

The barrier forming material is loosely draped from the pole such that it is not taut horizontally between the pole ends and so that it can absorb a large amount of energy which is imparted by the sports projectile. The barrier forming material can be flexible and is generally draped to fall directly under the pole. When the barrier forming material is a fabric it can be opaque so as to provide some kind of an advertising message or shade or it can be a net whose openings are sized to stop any projectile.

The barrier forming material is easily attached to the pole by a plurality of rings around the pole which can easily be slid along the pole from one end to the other to provide ease of assembly and disassembly of the unit and spreading of the net. When assembled, the ability of the net to slide easily along the pole also provides a means to absorb energy when the net is struck by a sports projectile.

At each end of the pole a stopper (ring stopper) is provided to prevent the rings, holding the barrier forming material (net), from coming off of that end of the pole. The stopper is a washer shaped object whose inside diameter fits tightly on the pole to hold it in position while its outside diameter is larger than the inside diameter of the rings. This prevents a net, draped from rings, from coming off the pole and allows the net to be stored on the pole reducing a step (threading the net on the pole) which might be necessary during the assembly and disassembly of the barrier structure.

The pole is provided with a hardened (i.e. metal) tip which aids placing the ends of the pole into the ground.

BRIEF DESCRIPTION OF THE DRAWINGS

FIG. 4, shows a Detail 4 of FIG. 1;

FIG. 7, shows a perspective view of an embodiment of FIG. 1 and a support structure according to the invention.

DETAILED DESCRIPTION

Embodiments according to this invention provide an easy to setup effective sports practice aid which can be setup almost anywhere to provide training for any of the number of sports which include sports projectiles. The frame of the sports net includes a single pole 10 (preferably a multi-segmented shock-corded fiberglass pole) bent into an arcuate arch shape with the ends of the pole 10 placed into the ground (avoiding use of one or more guy wires), provide an arch from which a net 15 can be draped (suspended). This arch can be vertical or it can be tilted a large angle (i.e. 45 degrees or more) from vertical (i.e. generally vertical) and still provide an energy absorbing barrier to reduce the energy of sports projectiles and stop them in the netting and/or near the ground under the pole. The net that is provided is extra long so that it drapes onto the ground and prevents any sports projectiles (i.e. golf balls) from slipping or rolling under the net which may result from a high projectile energy or a spin on the projectile. This prevents the sports projectiles from going a substantial distance from the sports net.

The net 15 is loose and therefore has a motion independent of the pole 10 when struck by a sports projectile, but after extending to its full dimension the net bends the pole 10 to absorb additional energy.

Figure 1:
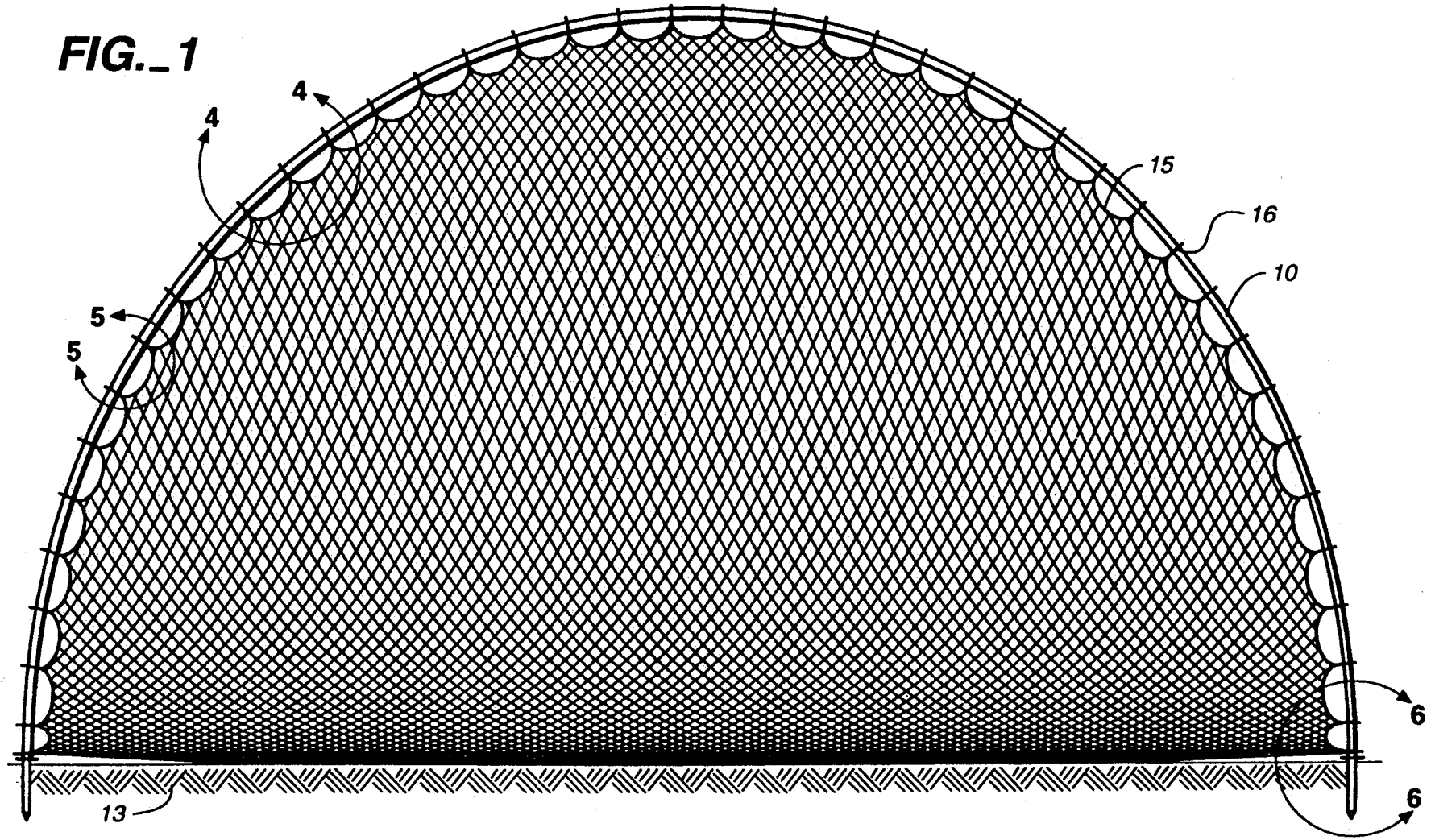
FIG. 1, shows a front view of an embodiment of the invention.

FIG. 1 shows an assembled sports net. The sports net consists of a pole 10 which is made of shock-corded 21 fiberglass segments 22, 23 which easily fit together to form a long flexible pole. When using ten segments of two feet each, the pole diameter is approximately 0.4 inches in diameter with a central hole (core) diameter of approximately 0.1875 inches. The shock-cord 21 fits within the inside hole and is approximately 0.125 inches in diameter.

Once assembled an end of the pole 10 is placed into the ground vertically and the pole is bent into an arch form so that the second end is placed into the ground approximately ten feet away from the first pole end. The pole extends into the ground about four or five inches and is thereby self-supporting. The height of the top portion of the arch is approximately 7½ feet when the pole ends are ten feet apart. The pole ends may be placed further apart thereby reducing the height of the arch at times when the user is interested in getting a maximum width. The pole ends may be placed closer together than ten feet to increase the arch height when it is necessary to capture projectiles which may rise to nearly the top of the arch.

A net 15 is provided and is attached to rings 16 which should have already have been placed on the pole prior to setup of the pole into its arch shape. The rings 16 are connected to the net 15 around the net upper perimeter. When the rings are evenly distributed around the poles 10, the arch provides a barrier to any projectiles trying to pass through the arch. The netting 15 is sized so that it hangs loosely within the arch and has a length which exceed the distance from the top of the arch to the ground 13 so that there is excess netting 15 on the ground 13 to catch any grounders or wrap around high energy projectile which impact the net close to the ground and capture them and prevent them from moving through the arch with very much energy.

FIG. 4 provides a close-up of FIG. 1. It shows the attachment of the netting 15 to the rings 16 which loosely surround the pole 10. The ring size is approximately 1⅛ inches O.D.

Figure 5:
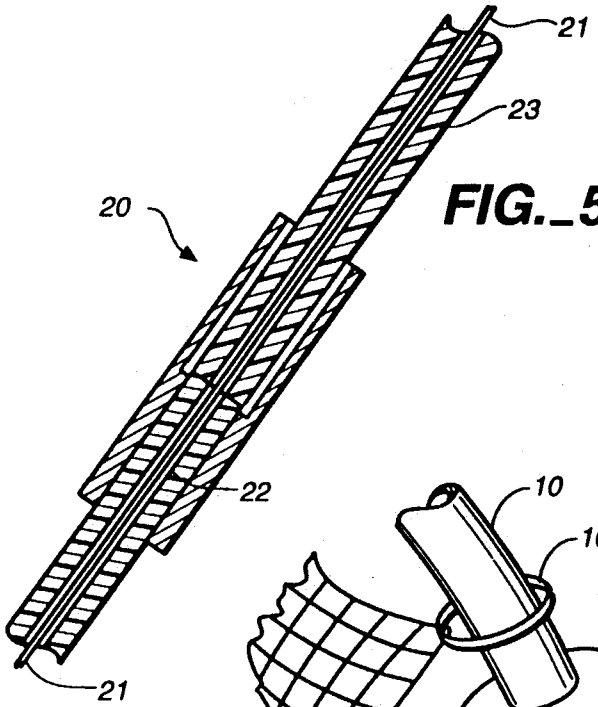
FIG. 5, shows a Detail 5 of FIG. 1.

FIG. 5 shows a close-up of a coupling assembly 20 for the pole 10 where a shock-cord 21 runs through the center of the pole and a female pole segment end 22 is mated with a male pole segment end 23.

Figure 6:
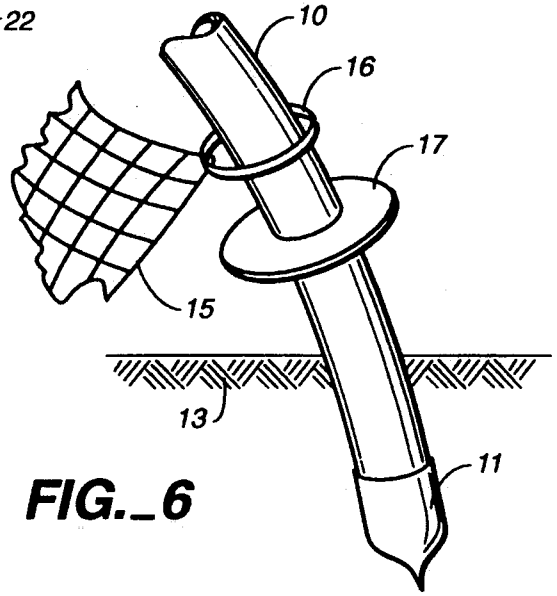
FIG. 6, shows a Detail 6 of FIG. 1.

FIG. 6 shows a closeup of an end of the pole 10 where the end of the pole has a pole tip 11 (i.e. a metal pointed tip) which assists in placing the pole end into the ground 13. A stopper 17 (i.e. a rubber washer) is positioned slightly above the ground 13 on the pole. The stopper 17 is held on the pole by compression and may easily be moved up and down the pole 17 10. The stoppers 17 are made of rubber approximately ⅛ inch thick and have an inside diameter of ⅜ of an inch, and an outside diameter of approximately one inch.

The net is a rectangular shape (not semicircular) which provides additional desirable slop or slack in the net when it is mounted in the half-moon shaped arch and is approximately eight feet by ten feet in size. The net openings are a diamond shape box shape having an approximately ⅞ inch opening (generally considered to be a standard golf net). There are approximately 50 rings distributed evenly around the net spaced approximately an average of about seven inches apart.

Figure 2:
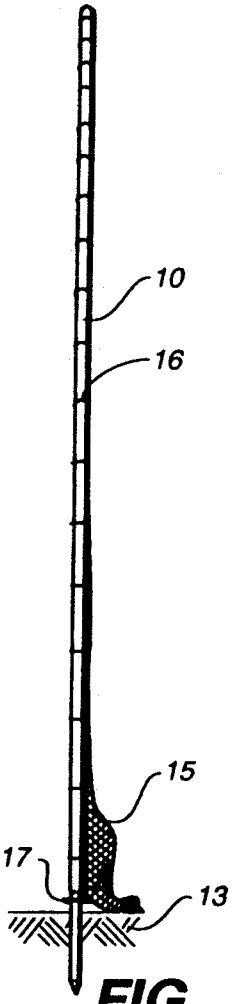
FIG. 2, shows a side view of FIG. 1 prior to projectile impact.

FIG. 2 shows a side view of the sports net of FIG. 1 prior to impact from a sports projectile. The end of the pole 10 is shown projecting into the ground 13 and the net 15 is shown in its loose hanging slack position clumped up directly below the arch of the pole 10.

Figure 3:
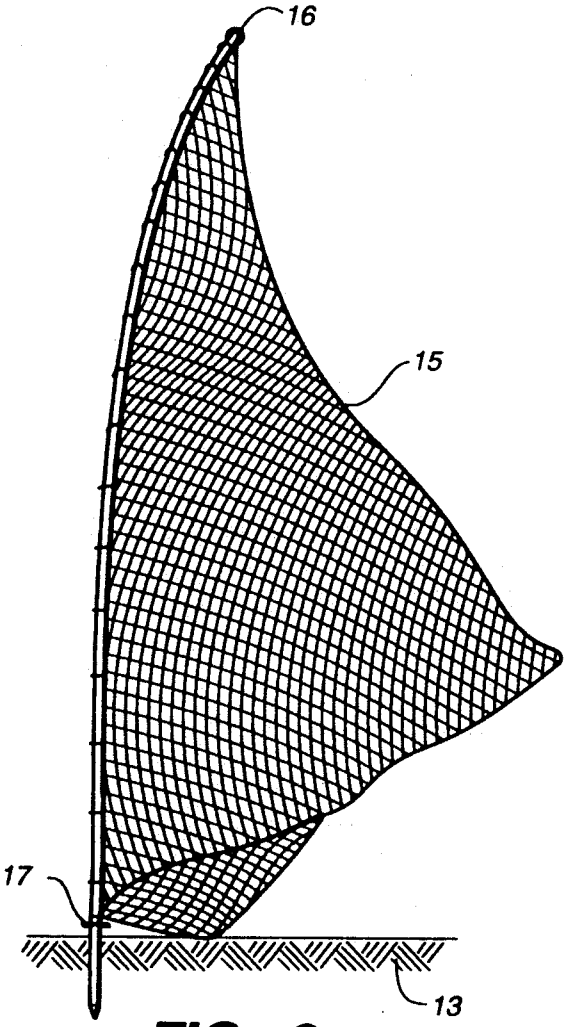
FIG. 3, shows a side view of FIG. 1 during a projectile impact event.

FIG. 3 shows a side view of FIG. 1 during a sports projectile impact event. The net 15 is extended (the rings 16 pivoting around the pole 10) from the arch enclosing a sport projectile (not shown) and the pole 10 is bent slightly, working together with the net, to absorb the energy of the projectile. The looseness of the net 15 together with the flexibility of the pole 10, in addition to the energy absorbing benefits, also provide the benefit of increasing net life by reducing the amount of stress that any particular strand of the net must endure. This construction also is capable of withstanding the impact of large sport projectiles (such as soccer balls, footballs, and baseballs), because it is able to absorb a larger amount of energy than other more tightly connected (taut) and less flexible sports nets.

FIG. 7 shows a stand assembly 30 which provides an above ground alternative for erecting the sports net. The stand assembly 30 consists of two mirror image end supports **30*a*, 30*b* connected by a cord 34. Each end 30*a*, 30*b* of the stand assembly 30 consists of a vertical pole receiving tube 31*a*, 31*b* and two horizonal support legs 32*a*, 32*b*, 32*c*, 32*d* and an alignment tube 33*a*, 33*b*. The pole 10 is inserted into each pole receiving tube 31*a*, 31*b*, and the spring-like resistance of the bending pole 10 causes the cord 34 to be put in tension between the two ends 30*a*, 30*b* of the stand assembly 30. The stand assembly 30 can be constructed of standard half inch pipe (i.e. ABS plastic or any other available tubing material), while the horizonal support legs 32*a*, 32*b*, 32*c*, 32*d*** can be constructed of any rigid connectable material.

An alternative to this construction is to provide only one horizonal support leg on each stand side **30*a*, 30*b* with a relatively heavy weight on top of the leg. For instance, if the horizonal support legs 32*a* and 32*c* were the only horizontal support legs and a sand bag or other large weight was placed on top of them, it would provide a stable structure not unlike the horizontal support legs 32*b*, 32*d***.

A pair of separate tubes could be driven into the ground to provide semi-permanent holes for mounting the sports net.

The cord 34 provides a fixed distance between the pole receiving tubes **31*a*, 31*b* (similar to placing the pole ends in the ground at a fixed distance apart). Once the cord 34 is extended and the pole receiving tube 31*a*, 31*b* are located, insertion of the ends of the pole 10 into their respective pole receiving tubes 31*a*, 31*b* will hold the pole 10** in its arching shape in a vertical attitude.

While the invention has been described with regards to specific embodiments, those skilled in the art will recognize that changes can be made in form and detail without departing from the spirit and scope of the invention.

We claim:

1. A barrier structure comprising:

a segmented flexible pole having a first end and a second end, said pole forming a curving arch over a ground surface, said pole being held only at said first end and said second end, said first end and said second end supporting said arch in a generally vertical position; and a flexible barrier forming material loosely draped from said pole between said first end and said second end of said pole along said pole substantially filling said arch between said pole and said ground surface when said material is in a slack condition, wherein when a force transverse to said arch, such as from a sports projectile or the wind, is applied to said barrier structure, said force can cause said material to become taut and said pole to bend to absorb the energy of the force and when said force ceases said flexible pole and material will rebound to its generally vertical position.

2. A barrier structure as in claim 1, wherein said pole is made of a flexible material such that said pole is straight when said ends are not held, wherein said pole has a first distance between said first and second ends when said pole is straight and said pole bows to form said arch when said first distance is reduced to a second distance by forcing said first end toward said second end.

3. A barrier structure as in claim 2, wherein said first and said second ends of said pole are held by a support structure to hold said pole in said arch.

4. A barrier structure as in claim 2, wherein said pole includes more than two segments.

5. A barrier structure as in claim 3, wherein said support structure is a piece of ground.

6. A barrier structure as in claim 1, wherein said pole is held by a support structure which includes means for receiving said first and said second pole ends and holding said first and said second pole ends generally parallel to each other and generally vertical to said ground surface.

7. A barrier structure as in claim 1, wherein said barrier forming material is a fabric.

8. A barrier structure as in claim 7, wherein said fabric is a net.

9. A barrier structure as in claim 1, wherein said material is attached to said pole by a plurality of rings.

10. A barrier structure as in claim 1, wherein there is a first predetermined linear distance between said first end and said second end when said pole is formed in said arch, wherein said barrier forming material is sized so that when loosely draped from said pole forming said arch in said slack condition, a first barrier forming material dimension linearly spanning said first predetermined linear distance is greater than said first predetermined linear distance.

11. A barrier structure as in claim 9, wherein said pole has a stopper attached to and supported by each of its ends to prevent said barrier forming material from coming off of said pole when said pole is not held.

12. A barrier structure as in claim 11, wherein said barrier forming material is storable by said rings attached to said material being slid along said pole until substantially all of said material is folded adjacent to a first of said stoppers at a first pole end while said rings attached to said material are still attached to said pole.

13. A barrier structure as in claim 1, wherein said pole is held by a piece of ground.

14. A barrier structure as in claim 6, wherein said support structure includes a set of two above ground supports providing longitudinal and lateral stability to said generally vertical arch, a first of said two above ground supports being connected to a second of said two above ground supports through a flexible connector.

15. A barrier structure as in claim 4, wherein said segments are rigidly connected when a longitudinal axis of each of said segments is located generally in-line and engaged with an adjacent segment and said segments are flexibly connected when each of said segments is not engaged with said adjacent segment.

16. A barrier structure as in claim 10, wherein there is a second predetermined length between a plane on which said arch is supported and a top portion of said arch, wherein said barrier forming material is sized so that when it is loosely draped from said arch in said slack condition, a second material dimension spanning said space from said top portion of said arch to said plane exceeds said second predetermined length.

17. A barrier structure as in claim 15, where the pole has a substantially hollow core.

18. A barrier structure as in claim 17, where a shock cord is connected to said first end and said second end of said pole through said hollow core.

19. A barrier structure as in claim 4, wherein said pole is substantially fiberglass.

20. A barrier structure as in claim 9, wherein said rings are non-collapsing and each ring directly engages a loop in a mesh of said net.

21. A sports net comprising:

a flexible pole having two ends each fixed in a holding device on a plane, said pole ends each being supported only by said holding device, said pole forming a generally curving arch shape generally vertical above said plane; and a net loosely draped within said arch substantially filling said arch shape between said pole and said plane when said net is in a slack condition, wherein when a force transverse to said arch, such as from a sports projectile or the wind, is applied to said sports net, said force can cause said pole to bend substantially to absorb the energy of the force and when said force ceases said flexible pole will rebound to its position generally vertical above said plane.

22. A sports net as in claim 21, wherein said holding device is a piece of ground.

23. A barrier structure comprising:

flexible means for forming a generally vertical and generally arcuate arch, said arch having a first end and a second end, said means for forming holding said arch in said generally vertical position only at said first and said second end;

a flexible barrier forming material; and means for loosely supporting a portion of said barrier forming material from said means for forming in a slack condition, wherein said barrier forming material substantially fills said arch, wherein a barrier portion of said arch is held fixed only by said first end and said second end, wherein when a force transverse to said arch, such as from a sports projectile or the wind, is applied to said barrier structure, said force can cause said flexible means to bend substantially to absorb the energy of the force and when said force ceases said springy means will rebound to its generally vertical position.

24. A sports projectile barrier structure for capturing sports projectiles and impinging on said barrier structure, said barrier structure comprising a flexible pole constructed of a number of straight pole segments linearly fitted together and assembled to form said pole, said assembled pole having a first end spaced from a second end, said pole being bendable with said pole ends being spacedly insertible with respect to the ground surface so as to form said pole into a fixed curved arched-shape extending generally vertically with respect to the ground surface;

a net attached to said pole and filling an area bounded by said arched-shape pole and the ground surface, said net hanging loosely within the area in a slack condition such that any projectile force impinging against said pole or loose net is absorbed by flexing of said pole or by movement of said loose net; and wherein said pole first and second ends are the only support points for said pole with respect to the ground surface.

25. The sports projectile barrier structure of claim 24 wherein said pole segments comprise a series of cylindrical segments each having a central hole and wherein said segments are held end-to-end by a shock cord extending through said central holes.

26. The sports projectile barrier structure of claim 24 wherein said net is attached to said pole by a plurality of rings spacedly affixed to said net and slidable on said pole

27. The sports projectile barrier structure of claim 24 wherein said pole first and second ends include a hardened tip for insertion of said ends into the ground surface.

28. The sports projectile barrier structure of claim 24 wherein said pole first and second ends are insertible into pole-receiving tubes supported by the ground surface.

29. The sports projectile barrier structure of claim 24 wherein said net is of a rectangular shape such that an excess of said net rests on said ground surface within the confines of said arched-shape pole.

30. The sports projectile barrier structure of claim 24 further comprising a ring stopper on each of said pole ends for preventing the net from coming off the pole during assembly and disassembly.

* * * * *